US006446300B1

(12) United States Patent
Sleezer

(10) Patent No.: US 6,446,300 B1
(45) Date of Patent: Sep. 10, 2002

(54) FOOT MOUNTED FLOOR DRYING DEVICE

(76) Inventor: Jill A. Sleezer, 7919 Charlotte, Kansas City, MO (US) 64131

( * ) Notice: Subject to any disclaimer, the term of this patent is extended or adjusted under 35 U.S.C. 154(b) by 0 days.

(21) Appl. No.: 09/620,402

(22) Filed: Jul. 20, 2000

(51) Int. Cl.[7] ..... A47L 13/20; A47L 13/282
(52) U.S. Cl. ..... 15/227; 36/113; 36/7.1 R
(58) Field of Search ..... 15/227, 228, 231, 15/209.1, 210.1; 36/7.1 R, 113, 15, 100, 9 R, 7.2; 134/6

(56) References Cited

U.S. PATENT DOCUMENTS

| | | | | | |
|---|---|---|---|---|---|
| 599,495 | A | * | 2/1898 | Durel et al. | 15/227 |
| 1,470,014 | A | * | 10/1923 | Kootz et al. | 15/228 |
| 2,075,229 | A | | 3/1937 | Rose | |
| 2,571,606 | A | * | 10/1951 | Peterson | 15/227 |
| 2,738,533 | A | * | 3/1956 | Peterson | 15/227 |
| 2,784,436 | A | * | 3/1957 | Peterson | 15/227 |
| 3,362,775 | A | | 1/1968 | Muecke | 15/227 |
| 3,460,182 | A | * | 8/1969 | Grande | 15/227 |
| 3,680,170 | A | | 8/1972 | Sims | 15/227 |
| 4,583,304 | A | * | 4/1986 | Spalding | 36/113 |
| 4,852,210 | A | * | 8/1989 | Krajicek | 15/228 |
| 5,173,985 | A | | 12/1992 | Palmer | 15/227 |
| D363,814 | S | | 11/1995 | Tsujino | D2/916 |
| 5,613,897 | A | | 3/1997 | Thompson, Jr. | 15/227 |
| 5,644,813 | A | * | 7/1997 | Puskas | 15/227 |
| 6,122,793 | A | * | 9/2000 | Pao | 15/227 |

FOREIGN PATENT DOCUMENTS

| | | | | |
|---|---|---|---|---|
| CH | 101582 | * | 10/1923 | 15/227 |
| CH | 131319 | * | 4/1929 | 15/227 |
| CH | 311746 | * | 2/1956 | 15/227 |
| WO | 90/05478 | * | 5/1990 | 15/227 |

* cited by examiner

*Primary Examiner*—Gary K. Graham
(74) *Attorney, Agent, or Firm*—Hovey Williams LLP

(57) ABSTRACT

A foot mountable floor drying device is disclosed as including a generally rectangular rigid plate that is secured to the foot of the user. The plate is larger than the foot so that the former does not contact the floor during use. The device includes a plurality of straps, each of which is sectioned and provided with suitable fastening material so as to be adjustably and releasably secured about the foot. An absorbent cloth pad is secured to the plate in an overlying relationship with the bottom face of the plate. The pad consequently absorbs moisture on the floor as it is the foot is scooted along the floor. It has been determined that the appearance of a floor cleaned and then dried with the inventive device is far superior in appearance than a floor that has been mopped with a cleaning agent and then allowed to air dry.

14 Claims, 1 Drawing Sheet

FOOT MOUNTED FLOOR DRYING DEVICE

BACKGROUND OF THE INVENTION

1. Field of the Invention

Figure 1:
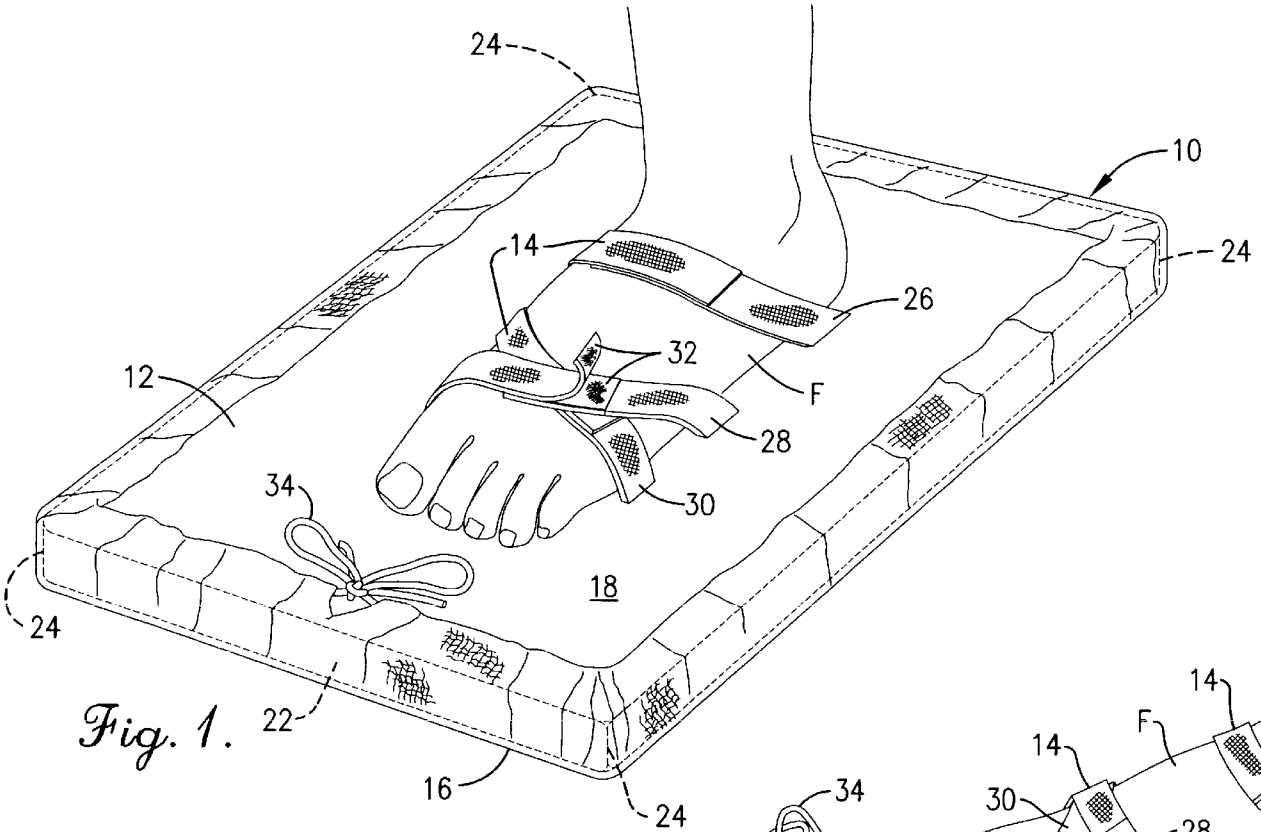

The present invention relates generally to floor cleaning equipment and accessories. More particularly, the present invention concerns a foot mounted floor drying device and method of using same, wherein use of the device provides the user with exercise and enhances the durability and appearance of the floor.

2. Discussion of Prior Art

A floor is traditionally cleaned by spreading a water-based cleaning fluid over the floor and, in some cases, subsequently rinsing the floor with water. Although a mop will sometimes be used to soak up pooled liquid, the floor is traditionally left wet and allowed to air dry. Those ordinarily skilled in the art will appreciate that a number of cleaning agents specifically suggest that the floor be permitted to air dry and that rinsing of the floor after application of the diluted agent is unnecessary.

It has been determined, however, that traditional floor cleaning methods present numerous problems. For example, traditional floor cleaning techniques have a tendency to leave an unsightly, dull film on the floor. It is also known that floors permitted to air dry remain wet for a significant period of time (e.g., fifteen to forty-five minutes), and this presents a hazard to individuals walking on the floor.

OBJECTS AND SUMMARY OF THE INVENTION

Responsive to these and other problems, an important object of the present invention is to provide an improved floor cleaning technique. Another important object of the present invention is to provide a device and technique particularly useful in eliminating the unsightly film often associated with traditional floor cleaning methods. Yet another important object of the present invention is to provide a film prevention device that has an inexpensive, durable and simple construction. It is also an important object of the present invention to provide a floor cleaning technique that eliminates the problematic film with the minimal amount of additional time and expense.

In accordance with these and other objects evident from the following description of the preferred embodiment, the present invention concerns a foot mountable floor drying device. It has been determined that drying of a floor, regardless of whether it is has been rinsed after application of the cleaning liquid, virtually eliminates the risk of a film residue. It has also been determined that complete drying of the floor actually results in some buffing thereof. This not only eliminates the customary film residue but also produces a shine on the floor, particularly on so-called "hardwood floors". With regard to the construction of the inventive device, it includes a substantially rigid plate presenting a bottom face and being removably attached to the users's foot by a foot attachment member. The device further includes an absorbent element substantially covering and being generally fixed relative to the bottom face of the plate. Thus, the user simply attaches the device to one or both feet and then scoots across the floor to effect the desired drying. It will be appreciated that such drying is accomplished while standing (eliminates work on the hands and knees), yet some aerobic activity is provided. The present invention also concerns a floor cleaning method generally involving use of the inventive device.

Other aspects and advantages of the present invention will be apparent from the following detailed description of the preferred embodiment and the accompanying drawing figures.

BRIEF DESCRIPTION OF THE DRAWING FIGURES

Figure 2:
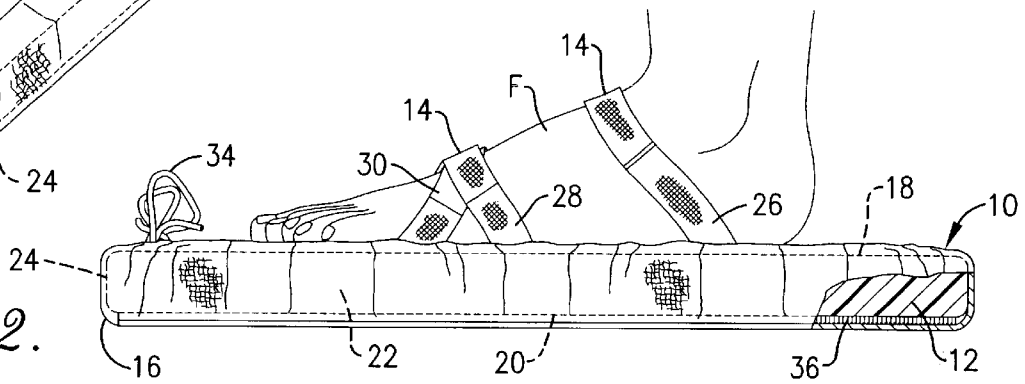

A preferred embodiment of the invention is described in detail below with reference to the attached drawing figures, wherein:

FIG. 1 is a perspective view of a floor drying device constructed in accordance with the principles of the present invention, with the device being shown attached to the left foot of a user; and FIG. 2 is a side elevational view of the device depicted in FIG. 1.

DETAILED DESCRIPTION OF THE PREFERRED EMBODIMENT

Turning initially to FIG. 1, the device 10 selected for illustration is shown attached to the left foot F of a user. As will be described further below, the device 10 is designed so that sliding movement of the foot F across the floor (not shown) causes any moisture thereon to be absorbed. It has been determined that the device 10 is particularly beneficial when used to dry the floor after a cleaning liquid has been applied thereto. The device 10 generally includes a rigid plate 12, a foot attachment member 14 that securely attaches the plate 12 to the foot F, and an absorbent element 16 fixed in an overlying relationship with the bottom of the plate 12.

As perhaps best shown in FIG. 1, the plate 12 preferably is flat and has a generally rectangular shape when viewed from the top (e.g., see the phantom lines in FIG. 1). The illustrated plate consequently presents flat, relatively parallel top and bottom faces 18 and 20, respectively, and a four-sided marginal face 22 extending between the top and bottom faces 18 and 20. The top face 18 is secured against the foot by the foot attachment member 14, and the bottom face is covered by the absorbent element 16. The top face 18 of the plate 12 is larger than the user's foot F so that all of the downward force associated with the foot F is applied against the plate 12. To accommodate most adult foot sizes, the illustrated plate 12 preferably has a length of at least about six inches and a width of at least about four inches. The four corners 24 of the plate are particularly beneficial when the device 10 is used to dry a floor having right-angle corners (not shown) along its perimeter. That is, the device 10 is easily manipulated into the corners of a floor so that drying of the entire floor is facilitated. It is noted, however, that the corners are slightly rounded (e.g., the corners are defined about an arc defined by a radius of less than about one-quarter inch). Those ordinarily skilled in the art will also appreciate that the flat bottom face 20 is specifically designed for use with flat floors (e.g., wood floors, linoleum, etc.).

However, the principles of the present invention are equally applicable to various other plate configurations. For example, it is entirely within the ambit of the present invention to utilize other variously shaped plates (e.g., a circular-shaped plate, a square-shaped plate, a somewhat elliptical plate to generally match the shape of the user's foot, etc.). It is also possible to provide a plate with a L-shaped bottom face so that the device may be used to dry stairs. The present invention also contemplates a plate having a top surface contoured to match the shape of the bottom of the user's foot F.

The plate 12 may be formed of any suitable material, such as plastic, wood, etc. It is preferred, however, that the plate 12 have sufficient rigidity to avoid generally all flexing thereof during use. One suitable material comprises ultra-high molecular-weight polyethylene having a thickness of at least about three-quarter inch. If desired, the top face 18 of the plate 12 maybe covered with a soft material (e.g., foam rubber) to improve the comfort of the device 10.

The foot attachment member 14 is preferably in the form of several straps 26,28,30 adjustably secured over the user's foot F to fixedly secure the plate 12 thereto. In the illustrated embodiment, each of the straps 26,28,30 is sectioned into two segments that are adjustably fastenable to one another. As particularly shown with respect to the strap 30 in FIG. 1, the undersurface adjacent the distal end of one of the strap segments and the top surface adjacent the distal end of the other strap segment are provided with complemental fastening structure 32 for permitting adjustable interconnection of the segments. The illustrated fastening structure comprises hook and loop fastening material, although other suitable fastening structure (e.g., snaps, buttons, a metal hook and spaced apart catches, etc.) may be used. The straps 26,28,30 are formed of any suitable material (e.g., nylon strapping). The straps 26,28,30 are preferably attached to the plate 12 by inserting each strap segment through an opening (not shown) extending through the plate 12 (from the top face 18 to the bottom face 20) and then being fixed to the bottom face 20 (e.g., by staples, adhesive, etc.). However, the straps 26,28,30 may be attached to the plate 12 in any other suitable manner. For example, the straps may each alternatively consist of a single element that loops around the underside of the plate or each alternatively comprise two segments that are attached to the top face 18.

It is noted that the rearmost strap 26 is configured and dimensioned to wrap over the foot just forward of the malleolus. The remaining two straps 28 30 are adapted to cross over one another along the top of the metatarsal region of the user's foot F. The straps 26,28,30 hold the foot F firmly against the top face 18 of the plate 14, particularly when the foot F is slid forwardly across the floor. If desired, the foot attachment member 14 may further include a heel strap (not shown) that projects from the plate forwardly of the ankle strap 26 and wraps around the heel of the foot F. It will be appreciated that such a heel strap would further inhibit relative movement between the user's foot F and the plate 12 when the foot F is slid rearwardly across the floor.

The foot attachment member 14 may further be variously constructed. For example, the principles of the present invention are equally applicable to a foot attachment member consisting of an upper or cover that encases the foot F. It will be appreciated, however, that the straps 26,28,30 are most preferred because they provide the greatest degree of ventilation while securely attaching the user's foot F to the plate 12.

Again, the absorbent element 16 overlies the bottom face 20 of the plate 12 and is thereby pressed against the floor as the foot F is slid across the floor. In the illustrated embodiment, the element 16 comprises a flexible sheet of fabric cloth that is removably attached to the plate 12. The sheet 16 preferably has a greater width and length than the plate 12 so that it wraps over the marginal face 22 and onto the top face 18, although it is only important that the sheet 16 cover the bottom face 20. The illustrated sheet 16 has a marginal passageway (not shown) formed therein preferably by folding all four edges over and attaching the sheet to itself. Received within the passageway is a drawstring 34 that may be drawn taut once the sheet 16 is placed over the plate 12 in the manner illustrated in FIGS. 1 and 2. The drawstring 34 is formed of any suitable material (e.g., nylon string) and may alternatively comprise a continuous elastic strap that need not be drawn taut and then knotted as shown. Moreover, the bottom face 20 of the plate 12 and the central portion of the interior surface of the sheet 16 are provided with complemental fastening structure 36 (see FIG. 2), preferably in the form of hook and loop fastening material, for securely fixing the sheet 16 to the plate 12. The hook and loop fastening material 36 preferably extends across substantially all of the bottom face 20 and is coextensive on both the plate 12 and the sheet 16. It is, however, entirely within the ambit of the present invention to provide spaced apart discrete strips on the plate 12 and/or sheet 16 or other material arrangements (e.g., hook and loop fastening material along the marginal face 22, etc.), if desired. Furthermore, other suitable fastening structure and arrangements may be used (e.g., reusable backing and adhesive layer, etc). It is also entirely within the ambit of the present invention to permanently attach the sheet 16 to the plate 12 so that the latter must be discarded with the former.

The sheet 16, particularly its exterior surface (the exposed, bottom surface of the sheet 16 in FIG. 2), is highly absorbent, such that moisture on the floor is quickly absorbed by the sheet 16 as the plate 12 is moved across the floor. The sheet is preferably formed of a thick cotton fabric having a terry-stitch exterior surface. In addition, the sheet 16 is preferably constructed so that it may be repeatedly wrung out during drying of the floor and may be washed in a conventional washing machine between uses. However, the principles of the present invention are equally applicable to other suitable absorbent materials. For example, the sheet 16 may alternatively comprise a chammy.

The use of the device 10 should be apparent from the foregoing description. It shall therefore be sufficient to explain that the device 10 is preferably used after moisture has been deliberately applied to the floor, although such deliberate application of the moisture is unnecessary. It will be appreciated that the moisture will usually be in the form of a cleaning liquid or water (often applied as a rinse after the cleaning liquid has been applied). The moisture is typically applied by standard mopping techniques. The device 10 is secured to the user's foot F by attaching the straps 26,28,30 in the illustrated manner, either before or after the cleaning liquid and/or water has been applied to the floor. The user then simply slides his/her foot F across the floor to absorb the moisture thereon. A device 10 may be secured to both feet, if desired. During use of the device 10, it may be necessary to remove the sheet 16 and wring it out so that additional moisture may be absorbed. It may also be necessary in some instances to secure a device 10 to only one foot so that the user's entire weight need not be applied against the device during drying of the floor.

Again, it has been determined that such a floor cleaning method not only serves to dry the floor but also eliminates the unsightly film residue often left with traditional cleaning techniques. It has also been determined that the floor is buffed to some degree, which further improves its appearance. Yet further is the aerobic but not overly strenuous activity provided to the user.

The embodiment described above is to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states her intent to rely on the Doctrine of Equivalents to determine and assess the reasonably fair scope of the present invention as pertains to any apparatus not materially departing from but outside the literal scope of the invention as set forth in the following claims.

What is claimed is:

1. A foot mountable floor drying device comprising:

a substantially rigid plate presenting a bottom face and a top face spaced from and generally opposite from the bottom face, said top and bottom faces being parallel and substantially flat, said plate presenting a four-sided outer margin that extends between the faces and said plate presenting four corners, such that the margin defines a generally orthogonal shape;

a foot attachment member configured to removably attach the plate to a user's foot; and an absorbent element substantially covering and being generally fixed relative to the bottom face of the plate, said absorbent element being snugly fit over the plate so that the absorbent element contacts each of the four sides of the margin and each of the four corners and conforms at least substantially to said generally orthogonal shape, said absorbent element being removably attached to the plate, said absorbent element presenting opposite interior and exterior surfaces, said interior surface of the absorbent element and the plate being provided with complemental fastening structure that serves to releasably attach the absorbent element to the plate.

2. A foot mountable floor drying device as claimed in claim 1, said foot attachment member being configured to secure the top face of the plate against the bottom of the user's foot.

3. A foot mountable floor drying device as claimed in claim 2, said plate being generally rectangular in shape.

4. A foot mountable floor drying device as claimed in claim 3, said corners of the plate being slightly rounded.

5. A foot mountable floor drying device as claimed in claim 4, said plate presenting a length of at least about six inches and a width of at least about four inches.

6. A foot mountable floor drying device as claimed in claim 1, said foot attachment member comprising a plurality of straps fixed to the plate and dimensioned to tightly wrap around the user's foot.

7. A foot mountable floor drying device as claimed in claim 6, said plurality of straps each including at least two sections provided with complemental fastening structure that permit the sections to be adjustably and releasably interconnected.

8. A foot mountable floor drying device as claimed in claim 7, said plurality of straps including an ankle strap adapted to wrap over the foot just forward of the malleolus and a pair of metatarsal straps adapted to wrap over the foot at a location spaced anteriorly of the ankle strap.

9. A foot mountable floor drying device as claimed in claim 1, said absorbent element comprising a flexible sheet.

10. A foot mountable floor drying device as claimed in claim 9, said flexible sheet being formed of a fabric cloth.

11. A foot mountable floor drying device as claimed in claim 1, said fastening structure being coextensive with the bottom face of the plate.

12. A foot mountable floor drying device as claimed in claim 11, said fastening structure comprising hook and loop material.

13. A foot mountable floor drying device as claimed in claim 1, said absorbent element being flexible and dimensioned to wrap over the outer margin and onto the top face of the plate, said absorbent element including a tightener that is operable to draw the absorbent element taught over the top face of the plate.

14. A foot mountable floor drying device as claimed in claim 13, said tightener comprising an elastic drawstring.

* * * * *